United States Patent [19]

Sung

[11] Patent Number: 4,551,923

[45] Date of Patent: Nov. 12, 1985

[54] DRAWING TRIANGLE

[75] Inventor: Sam C. Y. Sung, Taipei, Taiwan

[73] Assignee: Hou Sheng Chiang, Taipei, Taiwan

[21] Appl. No.: 613,578

[22] Filed: May 24, 1984

[51] Int. Cl.[4] ..... B43L 13/00

[52] U.S. Cl. ..... 33/476; 33/482

[58] Field of Search ..... 33/474, 476, 482

[56] References Cited

U.S. PATENT DOCUMENTS

| | | | |
|---|---|---|---|
| 4,345,383 | 8/1982 | Corsette | 33/474 |
| 4,461,092 | 7/1984 | Hore | 33/474 |

FOREIGN PATENT DOCUMENTS

| | | | |
|---|---|---|---|
| 137587 | 1/1934 | Austria | 33/474 |
| 1113816 | 4/1956 | France | 33/476 |
| 327320 | 8/1958 | Switzerland | 33/476 |
| 273601 | 7/1927 | United Kingdom | 33/474 |

*Primary Examiner*—Richard R. Stearns

[57] ABSTRACT

A drawing triangle is disclosed having 30-, 45-, and 105-degree angles. A perpendicular starting from the vertex of the obtuse angle meets the base at a right angle, from the point where said perpendicular meets said base a set of three reference lines extends making angles of 7 degrees, 30 degrees, and 42 degrees with the base line respectively. Inside the edges of the drawing triangle a set of three base lines each parallel to its corresponding edge are further provided. Between said inner base lines and the edges of the triangle, sets of broken parallel lines are provided which can be used to draw parallel lines with accuracy. Sets of scales are also provided along said perpendicular and the base edge of the drawing triangle.

10 Claims, 8 Drawing Figures

Fig. 1
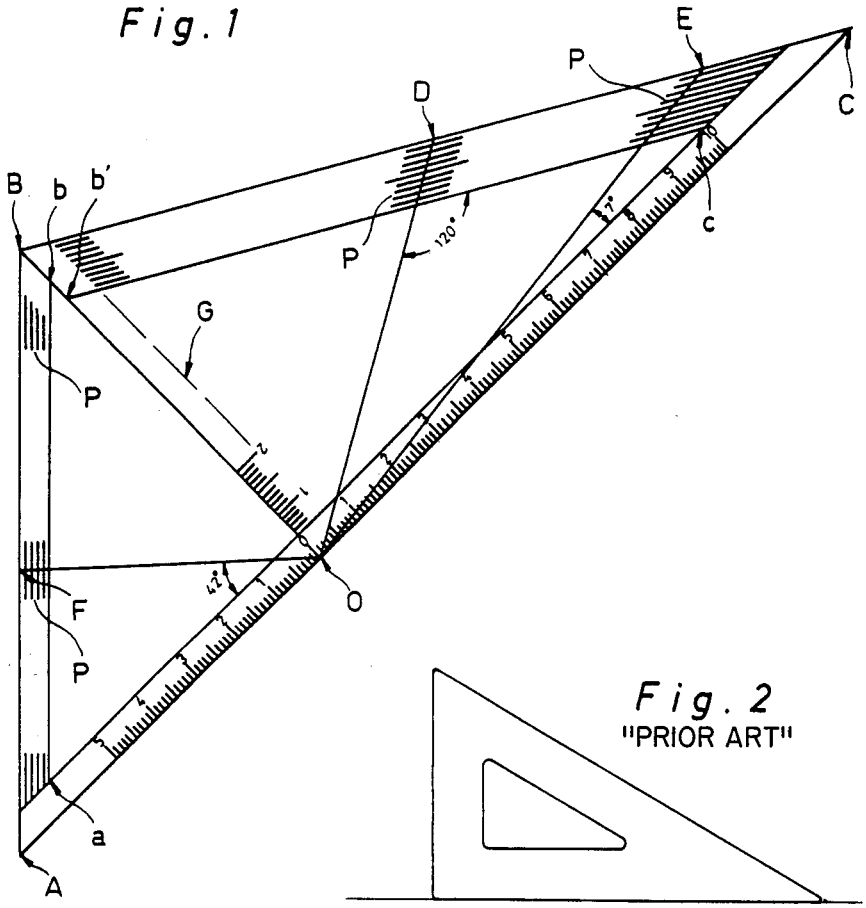
Fig. 2
"PRIOR ART"
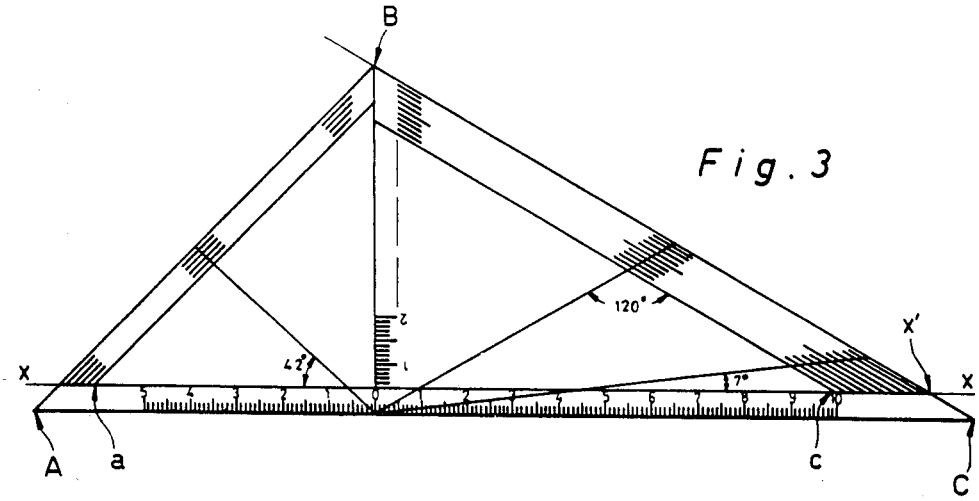
Fig. 3

"PRIOR ART"

DRAWING TRIANGLE

BACKGROUND OF THE INVENTION

This invention relates to drawing triangles for drawing accurately and conveniently parallel lines, special angles, perspective views of objects and the like.

Prior devices such as set squares and tee squares have certain deficiencies. For example, while applying a tee square and a set square to draw parallel lines, the tee square must be firmly held in its correct position, and the set square, having one of its edges coincide at with the the working edge of the blade of the tee square, must be slid along the blade edge of the tee square. In this manner, the draftsman, with one hand holding the drawing pencil, can only use the other hand to hold the two squares in their correct positions. This is not an easy task for novices as the squares may easily slip away from their correct positions.

This invention is designed to overcome such deficiencies by providing a single flat triangle featuring simplicity and accuracy of drawing.

SUMMARY OF THE INVENTION

The present invention provides a drawing triangle of flat unitary construction which has many advantages in clarity and ease of use for both experienced draftsmen and relative novices over prior devices such as the set squares and various measuring tools. The drawing triangle is designed to greatly simplify layout works yet be accurate. It is an improvement over the old-fashioned standard set squares, providing additional features and greater capabilities. The substantially obtuse-angled drawing triangle is provided with a set of base lines and special angles by marked lines on the surface of the transparent triangular plate together with sets of scales. Accurate parallel lines and accurate angles without distortions at the angle tip can be obtained by simple methods using the drawing triangle of this invention.

Aligning an initial line drawn on the working paper with a reference line that is marked on the under-surface of the transparent drawing tool is much more easier, most of all, much more accurate than aligning that initial line with the blade edge of any drawing tool. This is because every drawing tool has a thickness and such thickness at the drawing edge usually would produce shadow under illumination. If the direction of illuminating light source is not favorable, such shadow always blurs the vision of our eyes and makes the alignment of the lines inconvenient and even difficult.

This alignment problem does not arise in this invention, because virtually all alignments of an initial line drawn on the working piece are made with a reference line that is marked on the under-surface of the drawing triangle; in such cases, the two lines to be aligned are virtually in the same plane, the reference line would produce virtually no shadow on the work piece, and the alignment would be easy and accurate.

BRIEF DESCRIPTION OF THE DRAWINGS

This invention, together with its other features,will be described in the following paragraphs together with the accompanying drawings in which:

FIG. 1 is a plan view of the drawing triangle of this invention;

FIG. 2 shows the deficiencies of the conventional set squares when used for drawing a special angle of 30 degrees;

FIG. 3 shows the method of drawing a special angle of 30 degrees using the drawing triangle of this invention without distortion at its tip;

DETAILED DESCRIPTION OF THE PREFERRED EMBODIMENT

Figure 4:
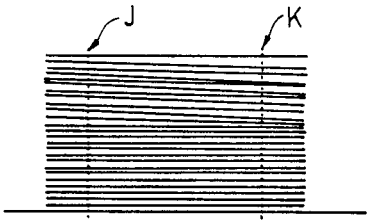
FIG. 4 shows the general deficiencies of the parallel lines drawn using conventional tools.

Refer now to the drawings. FIG. 1 shows the plan view of the device. The transparent triangular plate has an obtuse angle ABC measuring 105 degrees, and two acute angles BAC and ACB measuring 45 and 30 degrees respectively as is preferred in this embodiment. A perpendicular line from B meets the base line AC at O, and from O a line leads to side BC and meets BC at D, making an angle of 30 degrees with resepct to the base line AC. Two more lines set off from O and meet the edges BC and AB respectively at E and F which make angles of 7 and 42 degrees respectively with the base line AC as shown in the figure.

A scale, preferably a millimeter scale in this embodiment, is provided along the base line AC having point O as its origin zero and increasing its measure in both directions. Another scale is provided along the perpendicular OB also having point O as its origin zero and increasing its measure toward point B.

Three lines ab, b'c and ac are further provided, each of which is parallel to edges AB, BC, and AC respectively. Between the two edges of the drawing triangle AB and BC and the two lines ab and b'c are placed, sets of broken parallel lines P with a spacing between any two consecutive parallel broken lines approximating one smallest scale unit of the scale provided along base line AC and perpendicular line OB, that is, 1 millimeter in this embodiment. The number of parallel broken lines in the two sets is preferably five to ten.

There is one more dotted line G that is parallel to the perpendicular line OB. This dotted line can be used to define a 60-degree angle together with the line OD when necessary.

By some simple and convenient methods to be described in the paragraphs which follow, parallel lines and special angles can be drawn with good accuracy using the unitary drawing triangle of this invention.

The special angles can be drawn simply by coinciding one of the marked lines on the drawing triangle with the initial line and then drawing the other line of the desired angle along one of the drawing edges of the triangle.

The drawing triangle of this invention can be used to draw special angles without distortion at the tip point of the angle being drawn. FIG. 2 shows the deficiency of the standard set square having 30- and 60-degree acute angles and 90-degree right angle when used for drawing a special angle of 30 degrees. Since the set squares will have its tips worn out, thereby losing sharpness, the drawn angles are always insufficiently accurate at the tip. Usually they will have a round tip as shown in the figure instead of the desired sharp tip.

By using the drawing triangle of this present invention, this deficiency can be resolved, as is shown in FIG. 3. To draw a special angle of 30 degrees using the drawing triangle of this invention, first an initial line xx is drawn. Then the drawing triangle is shifted so that its inner base line ac coincides with the drawn initial line xx, and with the desired tip point x' of the 30-degree angle to be drawn meeting the edge BC of the drawing triangle. Next, only a line is needed to be drawn along the BC edge of the drawing triangle to complete the 30-degree angle. The angle thus obtained has an accurately shaped tip point, because the initial line and the second line are accurate straight lines, and the portion that may be subjected to wear and thus loss its accuracy, namely the tip at C, need not be to draw the lines.

The drawing triangle can also be used to draw parallel lines with accuracy easily. FIG. 4 shows the common problems that may result by using the commonly used drawing method. Usually, two points such as J and K of each line are first decided and marked on the paper, then each line is drawn by positioning the two points along the blade edge of a ruler.

Since the two points for each line may not have been correctly marked at the correct position, and since each drawn line may not have been drawn accurately passing through the two points just as well, quite a few deficient results may occur, such as those shown is the figure.

Figure 5:
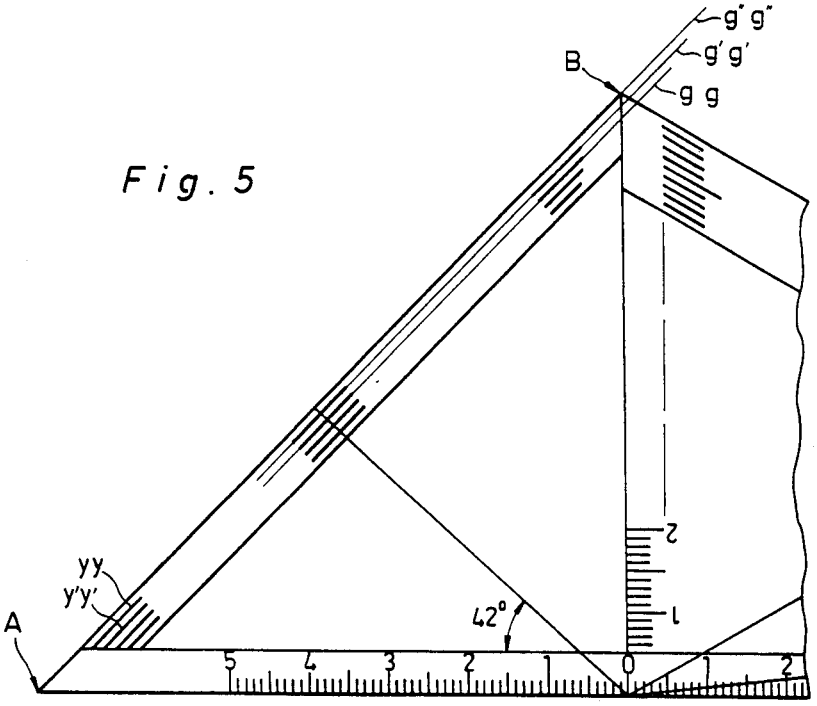
FIG. 5 shows the method of drawing a set of section lines using the drawing triangle of this invention.

Suppose now that a set of 45-degree section lines are to be drawn with the spacing of 1 millimeter between any two neighboring lines. Refer now to FIG. 5, in which the drawing triangle of this invention is used to draw the section lines. Firstly, an initial line gg is prepared, then, the first broken line yy on the triangle which is parallel to the edge AB of the drawing triangle is chosen to be accurately coincide with the initial line gg, and the second parallel line g'g' of the set of section lines is drawn along the edge AB of the triangle. Then, the drawing triangle is shifted to the left, having its first broken line yy coincide with the drawn line g'g'. At this moment, the second broken line y'y' on the drawing triangle which is next to the first broken line yy in the inward direction from edge AB of the triangle should accurately coincide with the initial line gg of the set of parallel section lines to be drawn. If not, the drawing of the line g'g' must have been insufficiently accurate, and must be corrected immediately. If it does coincide well, then the third line g''g'' of the set of section lines can be drawn along the edge AB of the drawing triangle. In this manner, the section lines can be drawn with accurate spacing between every two and with accurate parallelism.

Figure 6:
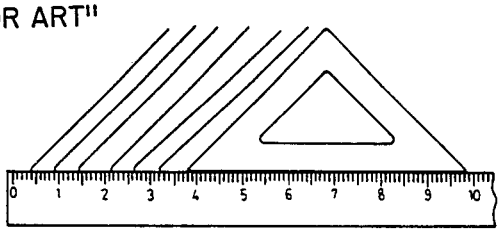
FIG. 6 shows the general deficiencies of the parallel special angles drawn using the conventional set squares.

The drawing triangle of this invention can also be used to draw parallel special angles. If the parallel special angles are to be drawn using the conventional set squares and tee square, in which method the tee square is held still and the set square having one of its edges pressed against the blade edge of the tee square and shifted along-side that edge, then since the tee square is sometimes unlikely to be held definitely still through the whole drawing process, certain drawing errors may result such as those shown in FIG. 6. In the figure it can be found that in addition to the problem of parallel, the problem of round tip of the drawn angle such as that shown in FIG. 2 are also present. These problems can easily be tackled by using the drawing triangle of this invention utilizing the drawing skills as disclosed in the above paragraphs.

Figure 7:
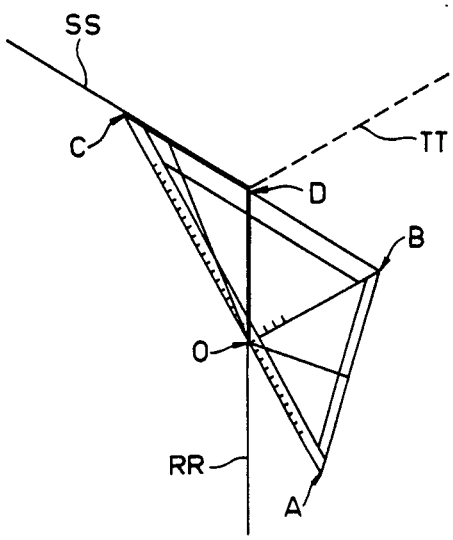
FIG. 7 demonstrates the utilization of the present invention for preparing the base lines of the perspective view of an object.

FIG. 7 demonstrates how the drawing triangle of this invention is used to prepare the base lines of the perspective view of an object. In this demonstration, an initial line RR is prepared first, and line SS which is to be drawn to make an angle of 120 degrees with respect to line RR by aligning line RR with the reference line OD on the drawing triangle such as shown in the figure, and the line SS can be drawn along the edge BC of the triangle. At this instance, the new line SS can again be treated as the initial line, and a third line TT as dotted in the figure can be prepared in the similar manner. Of course, angles other than 120 degrees can be prepared by using similar methods, which are convenient for the preparation of the perspective views of objects.

Figure 8:
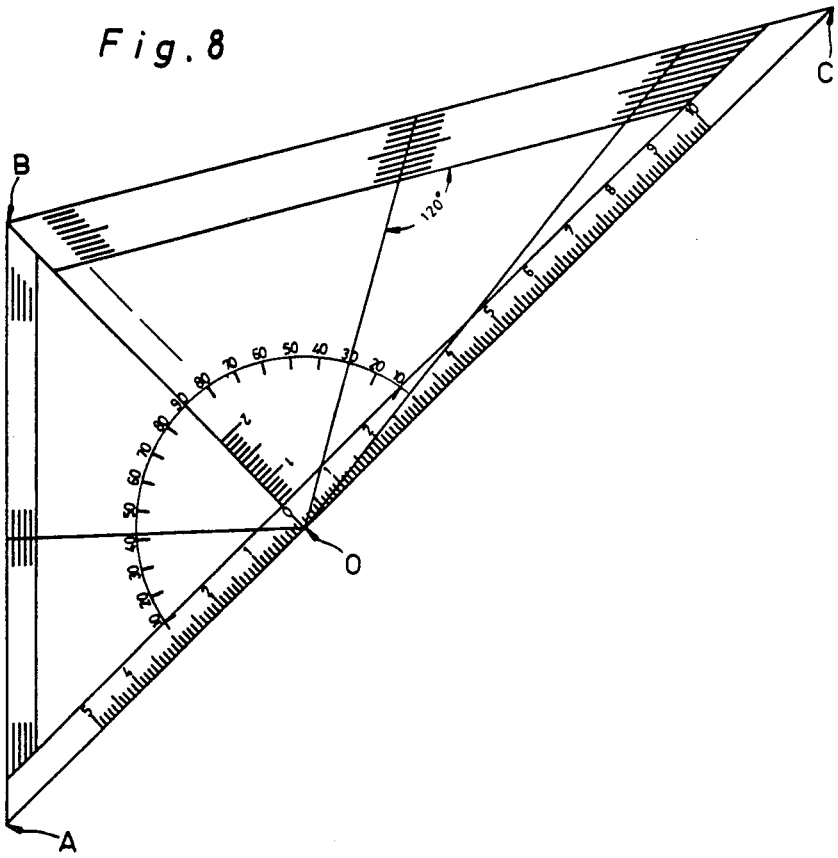
FIG. 8 shows the drawing triangle which is further furnished with protractor.

Further to the drawing triangle as described above, a protractor can be added as shown in FIG. 8 which can serve as a more convenient device.

From the above exemplary disclosure of the drawing triangle of this invention, any one skilled in this art, even a novice, can observe the simplicity of utilization of this inventive drawing triangle for drawing accurate and precision layouts, and the desirable results are obtained simply through the unitary drawing triangle, which makes many drawing works easy tasks.

Although various features of the invention have been particularly shown and described in connection with the illustrated embodiment of the invention, however, it must be understood that these particular arrangements are merely illustrative and that the invention is to be given its fullest interpretation within the terms of the appended claims.

I claim:

1. A drawing triangle comprising a transparent plate having one obtuse angle of 105 degrees, a first acute angle of 30 degrees, and a second acute angle of 45 degrees is characterized in that a perpendicular starting from the vertex of said obtuse angle meets the base edge of said drawing triangle that opposes said obtuse angle at a right angle at a first point;

from said first point a first line leads to a first edge that opposes said second acute angle and meets said first edge at a second point, said first line making an angle of 7 degrees with respect to said base edge;

from said first point a second line leads to said first edge and meets said first edge at a third point, said second line making an angle of 30 degrees with respect to said base edge and making an angle of 60 degrees with respect to said first edge;

from said first point a third line leads to a second edge that opposes said first acute angle and meets said second edge at a fourth point, said third line making an angle of 42 degrees with respect to said base edge;

a fourth line is parallel to said base edge;

a fifth line is parallel to said first edge;

a sixth line is parallel to said second edge;

a first set of parallel lines is provided between and parallel to said first edge and said fifth line; and a second set of parallel lines is provided between and parallel to said second edge and said sixth line.

2. The drawing triangle according to claim 1 which is further characterized in that a first scale is provided along said base edge having said first point as the origin of said first scale and increasing its measure in both directions toward said first and second acute angles; and a second scale is provided along said perpendicular having said first point as the origin of said second scale and increasing its measure at the direction toward said obtuse angle.

3. A drawing triangle according to claim 2 wherein the numbers of said first and second set of parallel lines are respectively ten and five and wherein the distance between every two consecutive said parallel lines is one smallest unit of at least one of said first and second scales.

4. A drawing triangle according to claim 3 wherein a protractor is provided with said first point as the center of said protractor.

5. A drawing triangle according to claim 1 wherein the numbers of said first and second set of parallel lines are respectively ten and five and wherein the distance between every two consecutive said parallel lines is one smallest unit of at least one of said first and second scales.

6. A drawing triangle according to claim 1 wherein said first and second sets of parallel lines comprises broken lines.

7. A drawing triangle comprising a transparent plate having one obtuse angle and first and second acute angles is characterized in that a perpendicular starting from the vertex of said obtuse angle meets the base edge of said drawing triangle that opposes said obtuse angle at a right angle at a first point;

from said first point a first line leads to a first edge that opposes said second acute angle and meets said first edge at a second point, said first line making an angle of 30 degrees with respect to said base edge and an angle of 60 degrees with respect to said first edge;

a second line is parallel to said base edge;

a third line is parallel to said first edge;

a fourth line is parallel to said second edge;

a first set of parallel lines is provided between and parallel to said first edge and said third line; and a second set of parallel lines is provided between and parallel to said second edge and said fourth line.

8. The drawing triangle of claim 7, further characterized in that from said first point a fifth line leads to a second edge that opposes said first acute angle and meets said second edge at a third point, said fifth line making a third acute angle with respect to said base edge.

9. The drawing triangle of claim 8, further characterized in that from said first point a sixth line leads to said first edge and meets said first edge at a fourth point which is disposed between said second point and said first acute angle.

10. The drawing triangle of claim 9, further characterized in that said obtuse angle is equal to 105 degrees and said first and second acute angles are equal to 30 and 45 degrees, respectively.

* * * * *